US005887277A

United States Patent [19]

Lohman

[11] Patent Number: 5,887,277

[45] Date of Patent: Mar. 30, 1999

[54] PROTECTIVE ELBOW PAD

[76] Inventor: Eric H. Lohman, P.O. Box 474, Vail, Colo. 81658

[21] Appl. No.: 916,138

[22] Filed: Aug. 21, 1997

[51] Int. Cl.[6] ..... A41D 13/08

[52] U.S. Cl. ..... 2/16

[58] Field of Search ..... 2/16, 24, 22; 128/878, 128/881; 602/20, 26, 62

[56] References Cited

U.S. PATENT DOCUMENTS

| | | | |
|---|---|---|---|
| 1,113,020 | 10/1914 | King | 2/16 |
| 2,550,461 | 4/1951 | Fick | 2/16 |
| 3,458,867 | 8/1969 | Moore et al. | 2/16 |
| 3,911,497 | 10/1975 | Lewis, Jr. et al. | 2/16 |
| 4,150,442 | 4/1979 | Boone | 2/24 |
| 4,198,708 | 4/1980 | Fugere et al. | 2/16 |
| 4,484,361 | 11/1984 | Leighton et al. | 2/16 |

*Primary Examiner*—Michael A. Neas
*Attorney, Agent, or Firm*—James E. Bradley

[57] ABSTRACT

A protective pad for the human elbow is formed from a layer of flexible, resilient padding material having a width and a length. The length of the padded material is divided into generally forward and rearward sections by a line which extends across the padding material's width. The forward section overlays the forearm and the rearward section overlays the user's upper arm. A hole located along the line is formed in the padded material and receives the user's elbow when the padded material is secured to the arm. The padding material bends along the line in response to bending of the user's arm. A securement strap is coupled to the layered padding material and is used to secure the padding material to the user's arm. Because the protective padding surrounds the user's elbow, the elbow is protected from impact while the protective pad is maintained in position on the user's arm.

15 Claims, 2 Drawing Sheets

PROTECTIVE ELBOW PAD

BACKGROUND OF THE INVENTION

1. Field of the Invention

This invention relates to a protective pad that may be worn on the arm to protect the elbow.

2. Description of the Prior Art

In many contact sports it is beneficial for the participant to wear pads or guards to protect certain areas of the body from injury. In certain sports, such as soccer, particularly for the goalie, it is oftentimes necessary for the players to fall or dive to the ground to achieve a particular play, such as when blocking the ball to prevent the opposing team from scoring. In such cases, the goalie typically lands on his or her elbows and forearms. Thus, it is important that the elbows and arms be adequately protected in order to avoid injury.

Some knee braces or supports are provided with a cut-out or hole for the kneecap or patella. These supports are usually made of a relatively thin, elastic material, such as neoprene rubber, that wraps tightly around the entire leg in the area of the knee to thus apply pressure and provide support to the knee and kneecap. Similar supports for the elbow are not provided with a hole or cut-out, but are formed of the same thin, elastic material that wraps tightly around the arm to supply pressure. While these devices may provide some protection, the material is too thin to provide sufficient protection from significant impact. In the case of knee supports, the kneecap typically projects a slight distance through the petallar opening so that it is exposed and subject to impact or abrasion.

Most of the prior art pads used to protect the elbow and forearms from impact are formed from a solid, continuous block or layer of padding material that is secured to the arm so that the elbow and forearm are covered. One of the problems with these prior art elbow pads is that they easily become dislocated and slide out of place. For purposes of comfort and ease of movement, the pads are not secured as tightly around the arm as are the elastic supports, such as the knee supports discussed above. These pads also tend to rub and chafe against the skin covering the elbow as the arm is flexed or bent. With continued usage, the prior art pads can eventually form blisters and abrasions on the skin.

What is therefore needed is an improved protective pad that can be worn on a person's arm to protect the elbow which absorbs shock and abrasion while remaining securely fixed in place.

SUMMARY OF THE INVENTION

A protective pad for the human elbow is provided from a layer of flexible, resilient padding material having a width and a length. The length of the padding material is divided generally into forward and rearward sections by a line which extends across the padding material's width. The forward section overlays the user's forearm, and the rearward section overlays the user's upper arm when the padding material is secured to the user's arm. The padding material has a hole located along the line for receiving the user's elbow. The padding material bends general along the line in response to bending of the arm. Further provided is a securement strap which is coupled to the layer of padding material for securing the padding material to the arm.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

Figure 1:
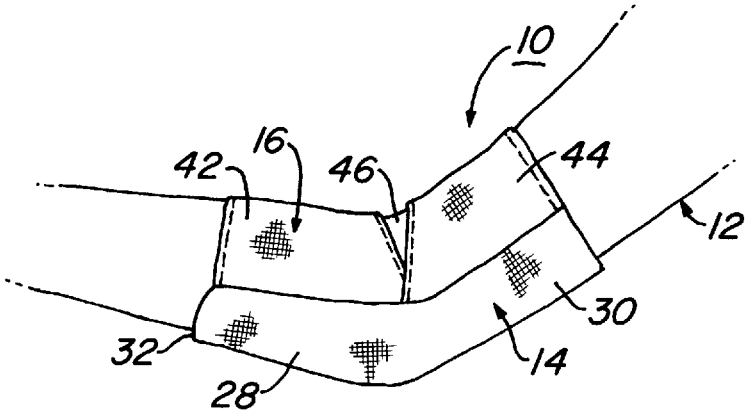
FIG. 1 is a side view of a protective pad secured to a person's arm and constructed in accordance with the invention.
Figure 2:
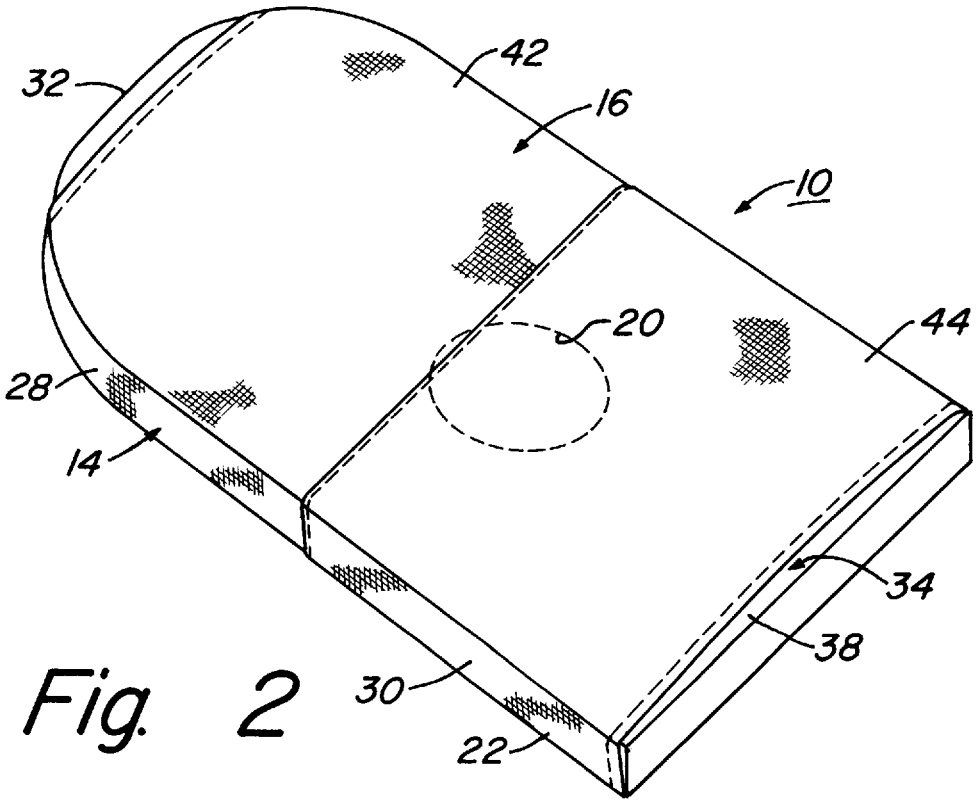
FIG. 2 is a top perspective view of the protective pad of FIG. 1 shown by itself and constructed in accordance with the invention.

Referring to the figures, FIGS. 1 and 2 show a protective elbow pad designated generally at 10 which is worn on a person's arm 12 (FIG. 1) for sports activities such as soccer, or the like, where there is a likelihood of injury to the elbow or forearm. The pad 10 is comprised of a padded portion 14 which is positioned over the user's elbow and is secured to the arm 12 by means of securement straps designated generally at 16.

Figure 3:
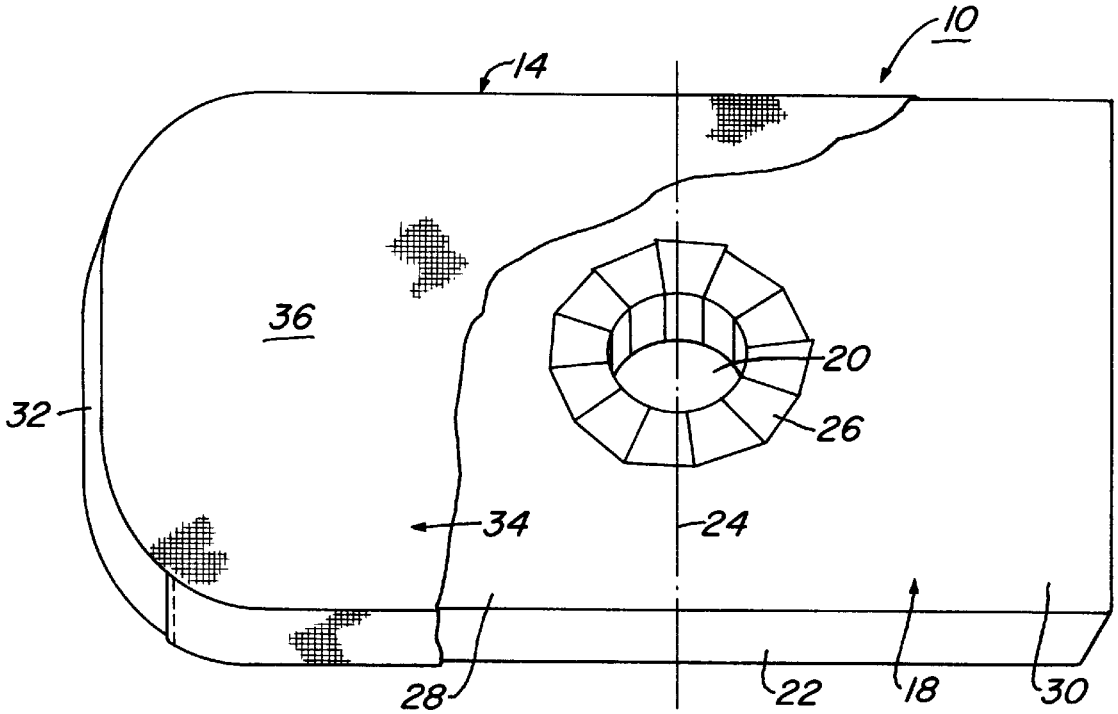
FIG. 3 is a bottom perspective view of the protective pad shown with covering material cut away to reveal a hole formed in the padding material in accordance with the invention.

As can be more clearly seen in FIG. 3, the protective pad 10 is formed with a layer 18 of padding material of a resilient, flexible polymeric foam. The foam padding material 18 may be either an open-cell or closed-cell foam. A suitable material is the polyurethane foam "PORON FOAM" available from Rogers Corp, Rogers, Conn. It should be apparent to those skilled in the art that other materials and foams could be used as well. The padding material 18 is formed from a single, generally rectangular block having a generally uniform thickness and a length greater than its width. While the thickness of the layer 18 may vary, it is preferably between ⅜" to ¾" in thickness.

Formed through the entire thickness of the layer 18 is a circular hole 20 which is centered an equal distance from opposite side edges 22 of the layer 18. The hole 20 may vary in size but will usually be between ¾" to 1¼" in diameter. The hole 20 is located along a line 24 which extends across the width of the padding layer 18. The line 24 is generally perpendicular to the longitudinal axis of the padding layer 18.

The hole 20 is reinforced with reinforcing material 26 which may consist of overlapping strips of fabric tape which are circumferentially applied around the hole 20. The reinforcing material 26 prevents the hole 20 from being stretched, torn or otherwise damaged during use of the pad 10.

The transverse line 24 divides the layer of padding material 18 into forward and rearward sections 28, 30, with the forward section 28 extending from the line 24 to the forward end 32 of the padding material 18, and the rearward section 30 extending from the line 24 rearward to the rearward end of the layer 18. The padding material 18 may have an overall length which varies between approximately 7 to 10 inches, and have a width of between 3½ to 6 inches. As is shown in FIG. 3, the forward section 28 of the padding material 18 is slightly longer than the rearward section 30. The length of the front section 28 of the padding material 18 is between 1 to 1.5 times greater than that of the rearward section 30. The greater length of the forward section 28 is due to the need for more protection of the user's forearm. The shorter rearward section 30, where there is less need for protection, makes the protective pad less cumbersome.

The forward end 32 of the padding material may have beveled or curved corners to streamline the pad 10 when it is worn on the arm 12. This prevents the pad 10 from catching on objects during use.

The padding material 18 is completely covered in a durable stretch or spandex-type fabric material 34, such as "LYCRA". The fabric covering 34 has a lower portion 36 and an upper portion 38. In the embodiment shown, the lower and upper coverings 36, 38 overlay the opening or hole 20, so that it is closed off. This is optional, as the fabric 34 can be configured to conform to the contours of the padding material 18, including the hole 20 so that the whole 20 remains open.

Referring to FIGS. 1 and 2, the strap 16 used for securing the pad 10 to the arm 12 consists of a forward band 42 and a rearward band 44. Both the forward and rearward bands 42, 44 are also formed from a durable stretch or spandex-type fabric material such as "LYCRA". As can be seen, the forward band 42 coextends with the length of the forward section 28 of the layer 18 and is joined generally along the side edges 22. Likewise, the rearward band 44 coextends with the length of the rearward section 30 of the layer 18 and is joined along either side edge 22. The forward and rearward bands 42, 44 may be sewn to the fabric covering 34 or formed from the same piece of fabric material used for the covering 34. When the pad 10 is placed on the user's arm, as shown in FIG. 1, the separate bands 42, 44 allow greater movement without bunching or gathering of the sleeve 16, as would exist if the strap 16 were one continuous piece coextending the entire length of the layer 18.

Figure 4:
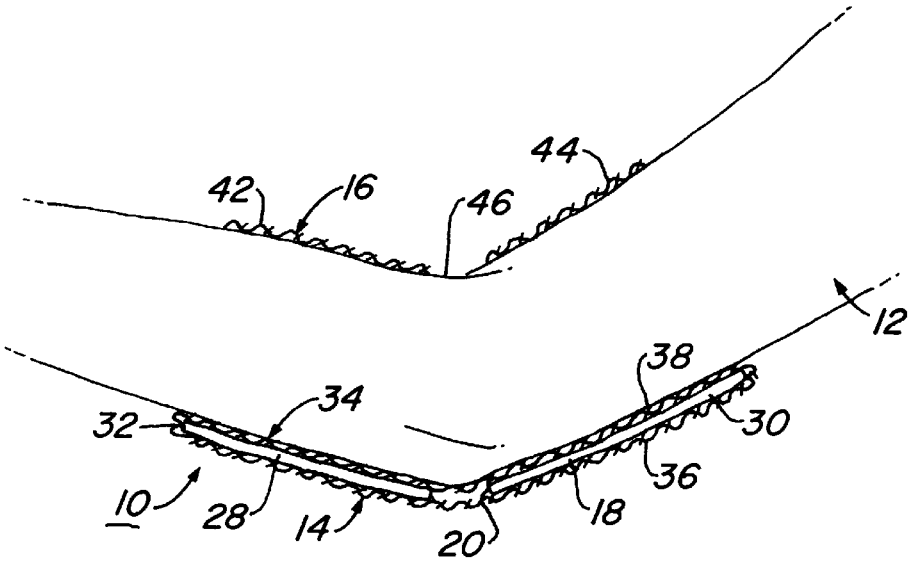
FIG. 4 is a cross-sectional view of the protective pad as it is shown secured to a person's arm.

The pad 10 is positioned on the arm by inserting the hand and arm through the forward and rearward bands 42, 44 forming the strap 16, and sliding the pad 10 over the arm until the hole 20 is positioned over the user's elbow. The elbow should only partially project through the hole 20 with the padding material immediately surrounding the hole 20 being sufficiently thick to protect the elbow. The forward section 28 of the padding material 14 should cover the lower portion of the user's forearm, and the rearward section 30 of the padding material 18 should extend along the lower portion of the user's upper arm, as shown in FIGS. 1 and 4. Even though the upper covering 38 covers the hole 20, the stretchable fabric material allows the elbow to penetrate the hole 22. The forward and rearward bands 42, 44 should provide a snug fit to help maintain the pad 10 in position, but should not be so tight as to restrict movement or cause discomfort. With the pad 10 secured to the user's arm as described, the layer 18 of padding material will bend generally along the line 24, which bisects the hole 20, as the user bends their arm.

With the elbow of the user's arm partially projecting into the hole 20, the pad 10 is maintained in position. This is an advantage over the prior art elbow pads which have no means of maintaining the pad in position on the arm other than the strap used to secure the pad to the arm. In addition, the separate forward and rearward bands 42, 44 allow greater freedom of movement and prevent bunching or gathering of the fabric material at the crook 46 (FIGS. 1 and 4) of the arm which would otherwise occur if a single band where used.

The protective elbow pad of the invention provides greater comfort and ease of motion when worn. The greater length of the forward section provides the forearm with the necessary padding protection, while the shorter rearward section allows greater freedom of movement and also protects the upper portion of the user's arm adjacent to the elbow. The padding material immediately surrounding the hole provides sufficient protection to the elbow so that it is unnecessary to have padding directly over the elbow.

While the invention has been shown in only one of its forms, it should be apparent to those skilled in the art that it is not so limited but is susceptible to various change without departing from the scope of the invention.

I claim:

1. A protective pad for the human elbow comprising:

a layer of flexible, resilient padding material having a width and the layer of the padding material being divided generally into forward and rearward sections by a line which extends across the padding material's width, the forward section overlaying the user's forearm, and the rearward section overlaying the user's upper arm when the padding material is secured to the user's arm, the padding material having a hole located along said line for receiving the user's elbow when secured to the user's arm, and wherein the padding material bends generally along said line in response to bending of the user's arm;

a securement strap coupled to the layer of padding material for securing the padding material to the user's arm; wherein:

the securement strap is a sleeve of stretch fabric material which generally coextends with the length of the padding material; and the sleeve is formed from a forward band which coextends with the length of the forward section of the padding material, and a rearward band which coextends with the length of the rearward section of the padding material.

2. The protective pad of claim 1, wherein:

the forward section of the padding material has a length greater than that of the rearward section.

3. The protective pad of claim 1, further comprising:

a fabric covering which closely receives the padding material, with the securement strap being joined to the fabric covering.

4. The protective pad of claim 3, wherein:

the fabric covering is formed from a stretch fabric material.

5. The protective pad of claim 3, wherein:

the fabric covering overlays the hole.

6. The protective pad of claim 5, wherein:

the length of the forward section is about 1 to 1.5 times greater than that of the rearward section.

7. The protective pad of claim 1, wherein:

the length of the padding material is greater than the width.

8. The protective pad of claim 1, wherein:

the padding material has generally straight opposite side edges which run along the length of the padding material.

9. The protective pad of claim 7, wherein:

the hole is generally located an equidistance from the side edges.

10. A protective pad for the human elbow comprising:

a layer of flexible, resilient padding material having a width and a length, the padding material having generally straight opposite side edges which run along the length of the padding material, wherein the length of the padding material being divided generally into forward and rearward sections by a line which extends across the padding material's width, the forward section overlaying the user's forearm, and the rearward section overlaying the user's upper arm when the padding material is secured to the user's arm, the padding material having a hole located along said line and generally an equidistance from the side edges for receiving the user's elbow when secured to the user's arm, and wherein the padding material bends generally along said line in response to bending of the user's arm;

a fabric covering which closely receives the padding material;

a sleeve formed from a stretch fabric material which is joined to the fabric covering for securing the padding material to the user's arm, the sleeve generally coextending with the length of the padding material; wherein the forward section of the padding material has a length greater than that of the rearward section; and the sleeve is formed from a forward band which coextends with the length of the forward section of the padding material, and a rearward band which coextends with the length of the rearward section of the padding material.

11. The protective pad of claim 10, wherein:

the length of the padding material is greater than the width.

12. The protective pad of claim 10, wherein:

the length of the forward section is 1 to 1.5 times that of the rearward section.

13. The protective pad of claim 10, wherein:

the width of the padding material is between about 3.5 to 5 inches, and the length of the padding material is between about 7 to 10 inches.

14. The protective pad of claim 10, wherein:

the fabric covering overlays the hole.

15. The protective pad of claim 10, wherein:

the hole has a diameter between about 0.75 to 1.25 inches.

* * * * *